US005946772A

United States Patent [19]

DeBower

[11] Patent Number: 5,946,772

[45] Date of Patent: Sep. 7, 1999

[54] COVER FOR A DOOR CLOSURE

[75] Inventor: Marc M. DeBower, Pleasant Hill, Iowa

[73] Assignee: Emco Enterprises, Inc., Des Moines, Iowa

[21] Appl. No.: 08/931,138

[22] Filed: Sep. 16, 1997

[51] Int. Cl.[6] ..... E05F 3/00; E05F 1/00; E05F 5/06; E05C 17/04

[52] U.S. Cl. ..... 16/84; 16/66; 16/71; 16/85; 292/262

[58] Field of Search ..... 16/66, 71, 84, 16/85, 82; 292/262, DIG. 1; 40/666, 660; 267/159; 188/322.12; 248/345.1, 74.2; 24/30.5 R, 563

[56] References Cited

U.S. PATENT DOCUMENTS

| | | | |
|---|---|---|---|
| 55,064 | 5/1866 | Cook | 24/563 |
| 2,057,881 | 10/1936 | Creamer | 24/563 |
| 2,768,457 | 10/1956 | Biek | 40/660 |
| 2,972,201 | 2/1961 | Niedermayer | 40/666 |
| 3,576,304 | 4/1971 | Gillemot et al. | 248/74.2 |
| 3,722,700 | 3/1973 | Cummings | 248/345.1 |
| 3,918,121 | 11/1975 | Williams | 16/128 |
| 4,813,100 | 3/1989 | King | 16/49 |
| 4,934,635 | 6/1990 | Sherman | 248/74.2 |
| 5,157,853 | 10/1992 | Piana et al. | 40/660 |
| 5,560,080 | 10/1996 | Reed | 16/82 |
| 5,575,513 | 11/1996 | Tuttle | 16/82 |

FOREIGN PATENT DOCUMENTS

| | | | |
|---|---|---|---|
| 0707857 | 4/1965 | Canada | 248/206.5 |

*Primary Examiner*—Brian K. Green
*Assistant Examiner*—Marcus Dolce
*Attorney, Agent, or Firm*—Zarley, McKee, Thomte, Voorhees & Sease

[57] ABSTRACT

A cover device for a door closure mechanism includes a detachably mounted shell which has a generally C-shaped cross section and is formed by an elongated wall. The wall has an inside surface which terminates laterally in opposing side edges. An elongated trough extends adjacent the inside surface of the wall and is adapted to receive the door closure housing. A pair of opposing jaw members protrude from the inside surface of the wall adjacent each of the side edges respectively. The opposing jaw members define a lateral opening, the lateral opening is smaller than the diameter of trough. The jaw members are resiliently or elastically deflectable in an outward direction to enlarge the throat opening so as to permit the door closure housing to be inserted laterally into the trough. Once the jaw members have been deflected over the full diameter of the housing, the jaw members spring inwardly to frictionally retain the cover on the door closure housing of the door closure mechanism.

11 Claims, 2 Drawing Sheets

10
14
28
32
34
36
38
40
42
44
46
48
50
52
54
56
58

COVER FOR A DOOR CLOSURE

BACKGROUND OF THE INVENTION

The present invention relates to the field of doors and the associated hardware for opening and closing them. More particularly, this invention relates to a cover for the closure mechanism on a storm door. The device installs easily without tools or fasteners, protecting the closure from moisture and dust once installed.

A primary objective of the present invention is the provision of an improved cover for the closure mechanism of a door.

A further objective of this invention is the provision of a cover that is easy to install without tools or fasteners.

A further objective of this invention is the provision of a cover that is retained on the closure mechanism by biased frictional engagement.

A further objective of this invention is the provision of a cover that has a streamlined shape which covers the key components of the closure without interfering with the function of the closure.

A further objective of this invention is the provision of a cover that is economical to produce, durable in use, and reliable.

These and other objects will be apparent from the drawings, the description, and the claims which follow.

SUMMARY OF THE INVENTION

The present invention relates to a cover device for a door closure mechanism. The door closure mechanism typically has a cylindrical housing. The cover device includes a detachably mounted shell which has a generally C-shaped cross section and is formed by an elongated wall. The wall has an inside surface which terminates laterally inside edges. An elongated trough extends adjacent the inside surface of the wall and is adapted to receive the door closure housing.

A pair of opposing jaw members protrude from the inside surface of the wall adjacent each of the side edges respectively. The opposing jaw members define a lateral opening which is smaller than the diameter of trough. The jaw members are resiliently or elastically deflectable in an outward direction to enlarge the throat opening so as to permit the door closure housing to be inserted laterally into the trough. Once the jaw members have been deflected over the full diameter of the housing, the jaw members spring inwardly to frictionally retain the cover on the door closure housing of the door closure mechanism.

DETAILED DESCRIPTION OF THE PREFERRED EMBODIMENT

Figure 1:
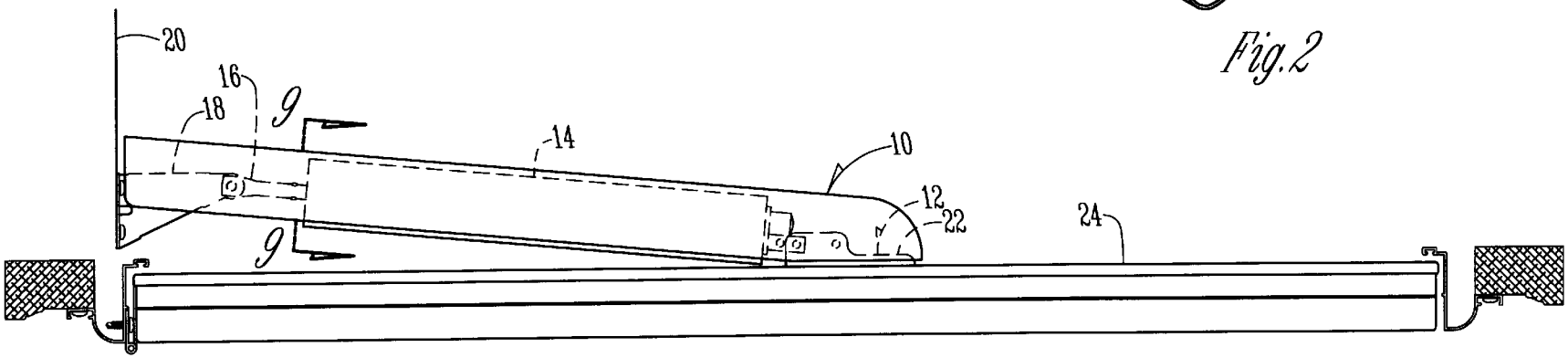
FIG. 1 is a top plan view of the cover device of present invention installed on the closure mechanism of a storm door.

In the drawings and the description, the door closure cover of this invention is generally denoted by the reference numeral 10. FIG. 1 shows the closure 10 installed on a conventional door closure 12. The cover 10 wraps around the typically cylindrical housing 14 of the closure mechanism 12 and is self-retaining thereon as discussed in greater detail below. The cover 10 extends longitudinally beyond at both ends of the housing 14. Thus, the rod 16 of the closure mechanism 12, the mounting bracket 18 pivotally connected to the rod 16, and the second mounting bracket 22 pivotally connecting the housing 14 to the door 24 are substantially covered by the cover 10.

Figure 2:
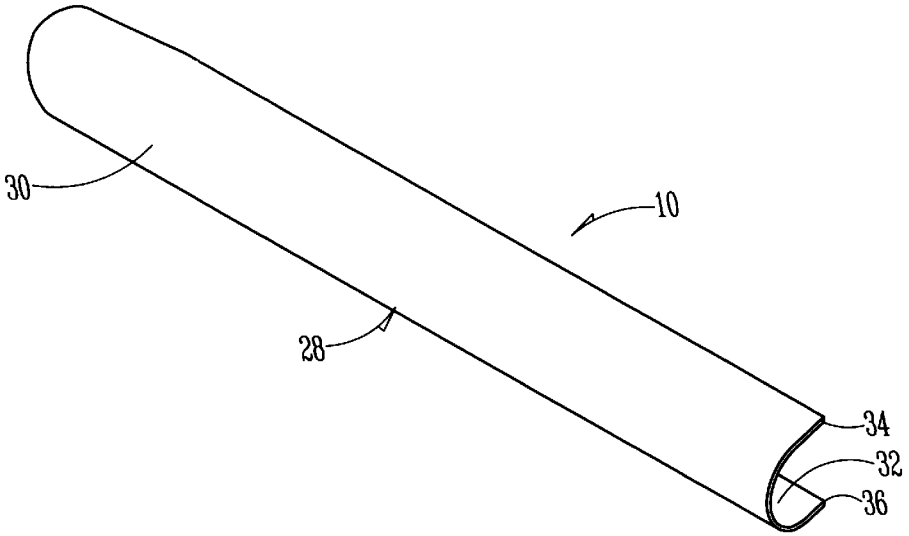
FIG. 2 is a perspective view of the cover device of this invention.

FIG. 2 shows the cover 10, which includes a shell 28 that is detachably mountable to the housing of 14 of the closure 12. The shell 28 is preferably formed of a plastic material which is substantially rigid. The shell 28 has a relatively thin wall 30 which is formed into a C-shaped cross section or curved in a transverse vertical plane. The elongated wall 30 has an inside surface 32 which terminates laterally in side edges 34, 36.

Figures 3, 4, 5, 6, 7, 8, 9:
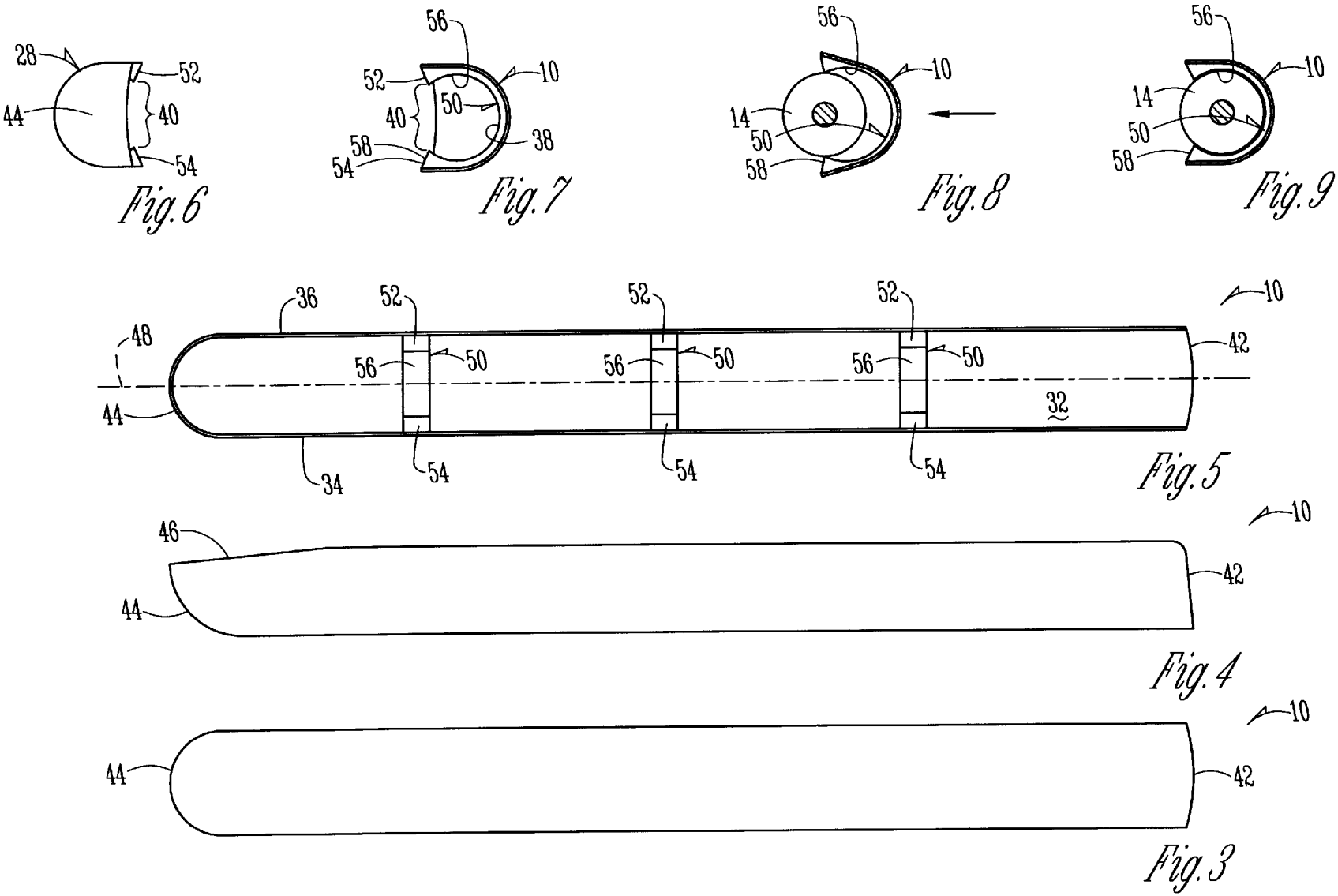
FIG. 3 is a front elevation view of the cover device of FIG. 2.
FIG. 4 is a top plan view of the cover device of FIG. 2.
FIG. 5 is a rear elevation view showing the inside of the cover device of FIG. 2.
FIG. 6 is a left elevation view of the cover device of FIG. 2.
FIG. 7 is a right elevation view of the cover device of FIG. 2.
FIG. 8 is a right elevation view similar to FIG. 7, but shows the cover being forcibly snapped onto a closure mechanism.
FIG. 9 is a right elevation view of the cover device of FIG. 8 once it is snapped into place on the closure mechanism.

As seen in FIGS. 2–7, the shell 28 has an open end 42 and a closed end 44 generally opposite the end 42. The open end 42 receives the rod 16 of the closure 12. The length of the cover shell 28 is preferably sufficient to cover the rod 16 and the mounting brackets 18, 22. The side edges 34, 36 of the shell 28 at the closed end 44 are mitered at an acute angle as shown in FIG. 4 to avoid interfering with the door 24 when installed on the closure mechanism 12 (FIG. 1). Thus, the side edges 34, 36 at the closed end 44 of the shell 28 comprise identically mitered edges 46. Other types of clearance configurations can be provided as needed to fit the installed closure mechanism 12 without interfering with door 24 or the frame 20.

FIGS. 5–7 illustrate that an elongated trough 38 extends adjacent the inside surface 32 of the wall 30. The trough 38 is adapted to receive the housing 14 of the door closure mechanism 12. The wall 30 extends more than 180° around the central longitudinal axis 48 of the shell 28, which leaves a lateral elongated throat opening 40 into the trough 38.

A pair of opposing jaw members 52, 54 protrude respectively from the inside surface 32 of the wall 30 adjacent each of side edges 36, 34 to further define the lateral throat opening 40. The jaw members 52, 54 are resiliently deflectable in an outward direction to change the size of throat opening 40. This permits the door closure housing 14 to be inserted laterally into the trough 38 through the throat opening 40. Thereafter, the jaw members 52, 54 spring inwardly to frictionally retain the shell 28 on the door closure housing 14.

As best seen in FIGS. 6–9, the jaw members 52, 54 have a generally V-shaped vertical cross section. Each jaw member 52, 54 includes a curved surface 56 which protrudes outwardly from the inside surface 32 of the wall 30 to intersect an entry surface 58 which preferably protrudes from the side edge 36, 34.

In order to save material and keep the required installation and removal forces low, the jaw members 52, 54 are preferably formed on one or more raised ribs 50 which extend transversely across the shell 28 on the inside surface 32 of the wall 30. It should be understood that the jaw members 52, 54 could be integrally formed on the inside surface 32 and extend continuously along the side edges 36, 34. In either case, the ribs and/or jaw members can be integrally formed on the wall 30 of the shell 28 by using conventional plastic injection molding techniques. A resilient or elastically deflectable plastic material makes the jaw members 52, 54 movable. Plastic also makes the shell 28 impervious to moisture and dust. Thus, the door closure 12 can be attractively concealed and protected at the same time. As stated above, the shell 28 is substantially rigid, but the thin wall, C-shaped design allows the wall 30 to be deflected at the jaw members 52, 54.

As best seen in FIG. 8, the cover 10 is installed on the door closure 12 by positioning the throat opening 40 adjacent the housing 14. Then force is applied to the shell 28 of the cover 10 as shown. The jaw members 52, 54 deflect outwardly as they are forced over the outside diameter of the housing 14. Once the jaw members 52, 54 have cleared the maximum diameter of the housing 14, the shell 28 will naturally tend to snap into place on the housing 14 as shown in FIG. 9. The natural elasticity and resiliency of the jaw members 52 causes them to wrap themselves tightly around the housing 14 and frictionally retain the cover 10 thereon. The cover 10 is removed by pulling it in a direction generally opposite that shown in FIG. 8.

The frictional engagement is tight enough to retain the cover 10 on the housing 14, but the cover 10 can be adjusted angularly as necessary with a small amount of turning force. However, in the absence of outside forces, the cover 10 remains fixed on the housing 14 without fasteners. Furthermore, no tools are required to install or remove the cover.

Thus, it can be seen that the present invention at least achieves its stated objectives.

In the drawings and specification there has been set forth a preferred embodiment of the invention, and although specific terms are employed, these are used in a generic and descriptive sense only and not for purposes of limitation. Changes in the form and proportion of parts as well as in the substitution of equivalents are contemplated as circumstances may suggest or render expedient without departing from the spirit or scope of the invention as further defined in the following claims.

What is claimed is:

1. In combination, a cover device and a door closure having a housing and a rod slidably extending from one end thereof, the cover device comprising:

a detachably mountable shell having a generally C-shaped cross-section formed by an elongated wall having an inside surface terminating laterally and opposing side edges, and an elongated trough adjacent the inside surface of the wall for receiving a door closure housing, a pair of opposing jaw members respectively protruding from the inside surface of the wall adjacent each of the side edges so as to define a lateral throat opening therebetween;

the jaw members being resiliently reflectable outwardly to enlarge the throat opening sufficiently to permit the door closure housing to be inserted laterally into the trough and thereafter the jaw members springing inwardly to frictionally retain the shell on the door closure housing;

the shell having a closed end disposed remote from the rod.

2. The combination of claim 1 wherein the closed end of the shell is mitered at an acute angle.

3. The combination of claim 1 wherein the wall is curved in a transverse vertical plane.

4. The combination of claim 1 wherein the jaw members are formed on a raised rib extending transversely across the shell on the inside surface of the wall.

5. The combination of claim 4 further comprising a plurality of longitudinally spaced ribs having the jaw members thereon.

6. The combination of claim 4 wherein the rib is integrally formed with the wall.

7. The combination of claim 1 wherein the jaw members have a generally V-shaped vertical cross section.

8. The combination of claim 1 wherein the shell is substantially rigid.

9. The combination of claim 1 wherein the shell is detachably mountable to the door closure without tools.

10. The combination of claim 1 wherein the shell is impervious to moisture and dust.

11. The combination of claim 1 wherein the trough is substantially cylindrical.

* * * * *